US008833426B2

(12) United States Patent
Ebbesen et al.

(10) Patent No.: US 8,833,426 B2
(45) Date of Patent: Sep. 16, 2014

(54) SCREENING ARRANGEMENT COMPRISING MEANS FOR MOUNTING SIDE RAILS AND METHOD OF MOUNTING SUCH A SCREENING ARRANGEMENT

(75) Inventors: Henning Ebbesen, Skjern (DK); Peder Solsø Thomsen, Skjern (DK)

(73) Assignee: VKR Holding A/S (DK)

( * ) Notice: Subject to any disclaimer, the term of this patent is extended or adjusted under 35 U.S.C. 154(b) by 0 days.

(21) Appl. No.: 12/451,087

(22) PCT Filed: Apr. 26, 2007

(86) PCT No.: PCT/DK2007/050047

§ 371 (c)(1), (2), (4) Date: Jan. 20, 2010

(87) PCT Pub. No.: WO2008/131759

PCT Pub. Date: Nov. 6, 2008

(65) Prior Publication Data

US 2010/0116449 A1 May 13, 2010

(51) Int. Cl.
*E06B 9/08* (2006.01)

(52) U.S. Cl.
USPC ..... 160/31; 160/23.1

(58) Field of Classification Search
USPC ..... 160/31, 323.1, 239, 313, 318, 24, 23.1, 160/381
See application file for complete search history.

(56) References Cited

U.S. PATENT DOCUMENTS

| | | | | | |
|---|---|---|---|---|---|
| 3,269,455 | A * | 8/1966 | Gillotti | 160/369 |
| 3,627,359 | A * | 12/1971 | Paul | 403/295 |
| 4,126,174 | A * | 11/1978 | Moriarty et al. | 160/266 |
| 4,610,282 | A * | 9/1986 | Brooks et al. | 141/46 |
| 4,944,341 | A * | 7/1990 | Trippner et al. | 160/98 |
| 5,881,525 | A | 3/1999 | Riegelman et al. | |
| 6,209,610 | B1 * | 4/2001 | Davies et al. | 160/26 |
| 6,267,168 | B1 * | 7/2001 | Davies et al. | 160/23.1 |
| 6,446,696 | B1 * | 9/2002 | Davies et al. | 160/243 |
| 6,701,994 | B2 * | 3/2004 | Goldenberg et al. | 160/31 |
| 2003/0196770 | A1 | 10/2003 | Wylie | |
| 2004/0216849 | A1 | 11/2004 | Goldenberg et al. | |
| 2006/0000559 | A1 * | 1/2006 | Bohlen | 160/31 |
| 2007/0284053 | A1 * | 12/2007 | Mullet et al. | 160/31 |

FOREIGN PATENT DOCUMENTS

| | | | |
|---|---|---|---|
| DE | 9216407 | U1 | 1/1993 |
| DE | 29907090 | U1 | 8/1999 |
| DE | 20204380 | U1 | 8/2002 |
| DE | 20210855 | U1 | 5/2003 |
| DE | 202005006219 | U1 | 8/2005 |
| WO | WO00/47858 | | 8/2000 |
| WO | WO2004/031524 | | 4/2004 |
| WO | WO2005/008013 | | 1/2005 |
| WO | WO2006/048014 | | 5/2006 |

* cited by examiner

*Primary Examiner* — Blair M. Johnson

(74) *Attorney, Agent, or Firm* — Merek, Blackmon & Voorhees, LLC

(57) ABSTRACT

A screening arrangement (1) has a top element (4) including a cover and two side rails (8, 9). The top element (4) is provided with a top rail (440) forming the front side of the top element and being connected to the cover of the top element (4). Side rails (8, 9) are adapted to be joined to the mitred ends of the top rail (440) by means a set of angular brackets cooperating with reception means in the back side of the top rail (440) and in the back side of the respective side rail (8, 9).

14 Claims, 6 Drawing Sheets

SCREENING ARRANGEMENT COMPRISING MEANS FOR MOUNTING SIDE RAILS AND METHOD OF MOUNTING SUCH A SCREENING ARRANGEMENT

The present invention relates to a screening arrangement adapted to be mounted in a frame to obtain a mounted position, comprising a top element including a cover extending, in the mounted position, in a first longitudinal direction defining a width direction, and two side rails, each side rail extending, in the mounted position, in a second longitudinal direction defining a height direction, said first and second longitudinal direction defining a plane.

Screening arrangements are known in many different variants. The top element is a central part of the screening arrangement, as it traditionally accommodates parts of the operating mechanism and possibly all or part of the screening body in the non-screening position. In one of its simpler forms, the top element is a box-shaped cover having a substantially rectangular front plate of a length corresponding to the width of the frame aperture to be screened. The front plate has, i.a., the function of covering the internal parts such as a roller shaft and other parts of the mechanism for operating the screening arrangement. Side rails may be provided to reduce the amount of light entering in the gap between the side edges and the frame side pieces, and possibly to hide cord systems forming part of e.g. a parallel guidance arrangement. Such a side rail may e.g. have a cross-section shaped substantially as an L having two flanges, of which the first flange abuts the inner side face of the frame side piece, i.e. the face closest to the panel element of the window. The second flange overlaps the side edges of the screening body.

In principle, mounting of such arrangements is carried out in substantially the same manner: The top element is connected to the frame at the top piece thereof, following which the side rails are connected to the sides of the frame. Possibly, the side rails may be connected to the top element as well, typically in a butt joint or in a joint in which the side rails are inserted behind the front plate such that the front plate overlaps the side rails.

Although such screening arrangements have proven to function well and are relatively easy to mount, customer demands have increased in recent years with respect to the desired overall aesthetic appearance of the screening arrangement. However, also for other considerations, e.g. relating to cleaning, it is desirable to have a smooth surface of the parts of screening arrangement that are visible from inside the room, i.e. the front of the screening arrangement. Hence, attempts have been made at substituting the butt joints or overlapping joints for mitred joints. Mitred joints are known per se from screening arrangements of other kinds, typically those forming a closed rectangular frame with four pieces, in which the screening body is stationary, and from e.g. picture frames. In general, mitred joints have been experienced as less conspicuous and are preferred for cleaning considerations.

Screening arrangements making use of mitred joints are the subject of e.g. DE utility model publications Nos 202 04 380 U1, 299 07 090 U1, and 20 2005 006 219 U1. Common to all of these documents, however, is the fact that the frame pieces may be made from profiles having the same cross-section, which facilitates the joining to a considerable extent.

In contradistinction to the above-mentioned screening arrangements configured as frames of substantially identical pieces, special precautions have to be taken in order to apply this system to screening arrangements having a top element of a rather complicated design. Hence, the design of the top element is to a great degree dictated by practical considerations. Furthermore, the geometrical configuration of the top element is very different from that of the side rails. Typically, the top element requires at least the space between the panel element to be screened and to the front side of the frame pieces. Some screening arrangements even protrude into the room, i.e. beyond the front side of the frame pieces. The side rails, on the other hand, are often of a relatively uncomplicated and slender design.

Moreover, due to a number of factors, such as the presence of inevitable manufacture tolerances and material variances in the frame to be screened, there might be other difficulties in obtaining the inconspicuous mitre joint aimed at. This is particularly the case if the screening arrangement is intended to be retrofitted, for instance by a do-it-yourself person. It is a well-recognized predicament that a certain unwillingness to follow installation instructions, particularly in combination with the above-mentioned factors, may lead to an incorrect abutment of the surfaces forming part of the mitre joint. Such an incorrect abutment leads to gaps and possibly overlaps between the rail parts at the joints. In turn, this may cause a distorted appearance and a reduced possibility of cleaning of the joints, and hence of the entire screening arrangement.

In order to alleviate the inconveniences with an incorrect abutment of the mitre joints, WO 2004/031524 A1 discloses a screening arrangement, in which a separate cover element is utilized to cover the joint between the top rail portion and the respective side rail. The use of a separate cover element, however, is not optimal from a point of view of ease of installation, appearance and cleanliness.

With this background it is an object of the invention to provide a screening arrangement, in which an inconspicuous and smooth transition between top element and the side rails is obtained.

It is a further object of the invention to provide a screening arrangement that is easy to mount.

These and further objects are met by a screening arrangement of the kind mentioned in the introduction, which is furthermore characterized in that said top element is provided with a top rail forming the front side of the top element and being connected to the cover of the top element, said top rail extending in said first longitudinal direction between a first mitred end and a second mitred end, each of said side rails having a first end and second mitred end, the second mitred end of each side rail being adapted to be joined to the first and second mitred end, respectively, of said top rail, and that the screening arrangement furthermore includes a set of angular brackets, each angular bracket being adapted to cooperate with reception means in the back side of the top rail and in the back side of the respective side rail.

By providing the part of the top element to form part of the joint as a top rail, a number of advantages are obtained: First, when designing the top rail, only those aspects relating to the mitre joint and the overall appearance have to be considered. Hence, a considerably increased degree of freedom in designing the top rail has been obtained. Second, as the reception means for the angular bracket are formed in the back side of the top rail and of each side rail, respectively, the joining of the mitred ends may take place without particular difficulty and at the same time, the inconspicuous mitre joint aimed at is obtained.

The angle of the mitre joint depends on the dimensions of the elements joined end to end. In a preferred embodiment, the top rail has a predetermined height and each side rail has a predetermined width, and said predetermined height is substantially the same as said predetermined width, the mitre joint thus being a 45° mitre joint. As the top rail and the two side rails have the same dimension in the direction perpendicular to the respective longitudinal direction, the screening arrangement obtains a particularly harmonic appearance.

The inconspicuous overall appearance of the screening arrangement is increased even further in an embodiment, in which each angular bracket has a substantially plane configuration and includes a first leg and a second leg, said first and second legs being adapted to be positioned substantially in parallel with said plane in the mounted position, and wherein said reception means are provided as a track in the back side of the top rail and a track in the back side of each side rail, respectively. Furthermore, by allowing the angular brackets and reception means to extend in one plane on the back side of the top rail and the side rails, a reliable guidance between the top rail and the side rails is obtained while at the same time avoiding an elaborate design of these elements.

In order to ease the mounting procedure and to enhance the mutual retention of the surfaces forming part in the end-to-end joint between the top rail and the side rails, each angular bracket may be provided with a resilient adjustment portion. Preferably, the resilient adjustment portion of each angular bracket comprises at least one tongue at one edge of at least one leg.

In a further development of this embodiment, the at least one tongue is provided on one of the edges of each leg. This provides for an optimum guidance during mounting and retention of the joint. Preferably, the tongue or tongues of the first leg is/are provided at a first edge, and the tongue or tongues of the second leg is/are provided on the second edge.

In one embodiment, which is particularly advantageous in the case that the screening arrangement is adapted to have a predefined supply condition, the first leg is adapted to be inserted into the track in the back side of the top rail, the tongue or tongues of the first leg having a protrusion protruding from the edge of the first leg. This makes it possible to insert the angular brackets into the track of the top rail at the respective end thereof and to secure that these angular brackets are retained safely in place until the screening arrangement has been brought to the customer.

In order to facilitate the mounting, the second leg may be adapted to be inserted into the track in the back side of the side rail, one edge of the second leg having an inclined portion.

In a further embodiment, which improves the retention of the joint between the top rail and the respective side rail even further, the angular bracket is provided with an incision. During mounting, the side rail is guided along the second leg of the angular bracket until the shorter edge reaches the connecting point between the two adjacent edges of the first and second legs. In this position, the side rail is pivoted about a point corresponding to the start of the incision and the side rail is thus forced into a tight joint with the top rail.

Tolerances in the frame, e.g. deviations from a straight line or plane of the top and side pieces, may be compensated for in an embodiment, in which said top rail is provided with a protruding flange extending between the first mitred end and the second mitred end and having a predefined height, and wherein each side rail is provided with a protruding flange extending between the first end and the second mitred end and having a predefined width. In the mounted position, the flanges will cover any unevenness in the top and side pieces.

In order to increase installation comfort, each mitred end of the top rail and of each side rail may be chamfered. Thus, the presence of pointy ends of the top rail and side rails is avoided.

Preferably, the top rail has a larger extent than the cover of the top element in the first longitudinal direction, thus leaving room for a coupling member at each end of the top element. This makes the mounting easier and a more compact design of the screening arrangement is obtained.

The light-proof qualities of the screening arrangement are particularly secured in an embodiment, in which the screening arrangement furthermore includes a bottom element and a screening body, said screening body including a first end edge, a second end edge and two side edges, the first end edge being accommodated in the top element and the second end edge fastened to the bottom element, said bottom element being movable between a non-screening position close to the top element and a screening position at a distance from the top element, the side edges being guided in said side rails.

In a further aspect of the invention, a method of mounting a screening arrangement in a frame is provided. The method includes the following steps:

providing a top element with a top rail having a first mitred end and a second mitred end, providing two side rails having a first end and second mitred end, providing a set of angular brackets, connecting the angular brackets to the top rail, connecting the top element to the frame, joining the side rails to the top rail at the mitred ends by means of the angular brackets.

Preferably, the screening arrangement is brought to a supply condition by performing the first four steps, and the last two steps are intended to be performed at the installation site.

In the following the invention will be described in further detail by means of examples of embodiments with reference to the schematic drawings, in which FIG. 1 is a perspective view of a window provided with a screening arrangement in an embodiment of the invention;

FIGS. 1 and 2 show an embodiment of a screening arrangement generally designated 1.

Figure 1:
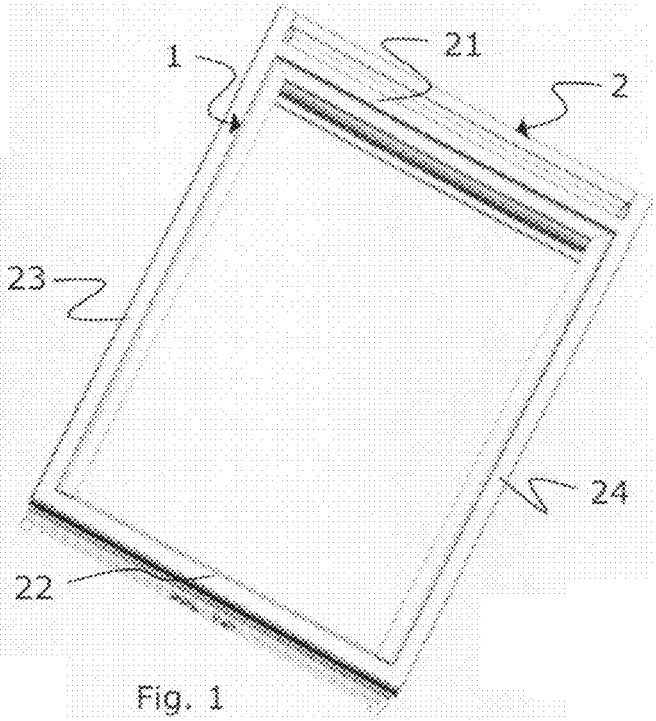

As shown in FIG. 1, the screening arrangement is adapted to be mounted on the internal side of a frame constituted by a sash 2 representing a window. The sash 2, in turn, is adapted to be connected with a stationary frame (not shown), which in a mounted position of the window lines an opening in a building. It is noted that the term "frame" is to be understood as incorporating any substantially rectangular structure positioned in any opening in a building, whether in a wall or the roof, and surrounding an aperture to be screened. The term "internal side" is to be understood as the side of the frame facing the aperture to be screened. Although the sash shown in FIG. 1 is the sash of a roof window and the screening arrangement 1 is mounted on the sash 2 of the window, a screening arrangement according to the invention may just as well be mounted on the stationary frame instead of the sash and may also be utilized in connection with e.g. windows having a frame only, or in doors.

Figure 2:
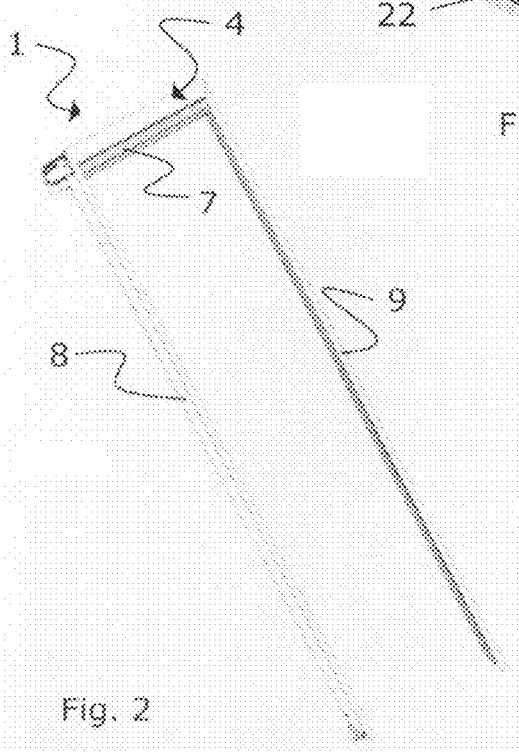
FIG. 2 is a perspective view of the screening arrangement shown in FIG. 1.

The sash 2 has a top piece 21, a bottom piece 22 and two side pieces 23 and 24 surrounding an aperture, which is covered by a suitable panel element such as a glazing in the form of an insulating pane (not shown). In the embodiment shown, the screening arrangement 1 comprises a top element 4 positioned at the sash top piece 21, a screening body 6 (not shown in FIG. 1 or 2, cf. however FIG. 3) and a bottom element 7. At its upper end edge, the screening body 6 is accommodated in the top element 4 and its opposed, lower end edge is fastened to the bottom element 7. In the embodiment shown, the bottom element 7 is adapted to act as a handle during operation of the screening arrangement 1, i.e. when moving the bottom element 7 and hence the screening body 6 between the non-screening position shown in FIGS. 1 and 2 and a screening position, in which the screening body 6 covers the sash aperture partly (cf. FIG. 3) or fully. However, instead of being manually operated, the screening arrangement may be operated by other means, e.g. by electrical operating means.

Furthermore, the screening arrangement 1 comprises two side rails 8 and 9 adapted to be connected to a respective side piece 23 and 24 and to the top element 4, in a manner to be described in further detail below. In the mounted position of the screening arrangement 1, opposite ends of the bottom element 7 and opposite side edges of the screening body 6 are guided in these side rails 8 and 9. In the embodiment shown, the screening arrangement comprises a roller blind having as its screening body 6 a cloth or fabric, and of which the top element 4 includes a spring-biased roller bar. However, other screening arrangements having other kinds of screening bodies and other configurations of the top element are conceivable as well.

Figure 3:
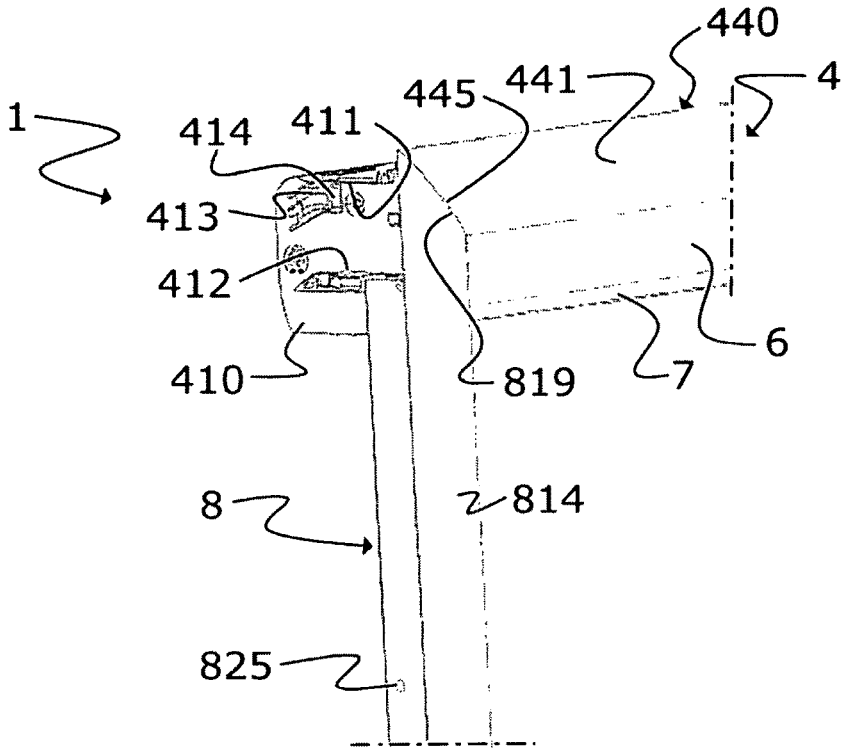
FIG. 3 shows, on a larger scale, a partial perspective view of a detail of the screening arrangement in an embodiment of the invention.
Figure 4:
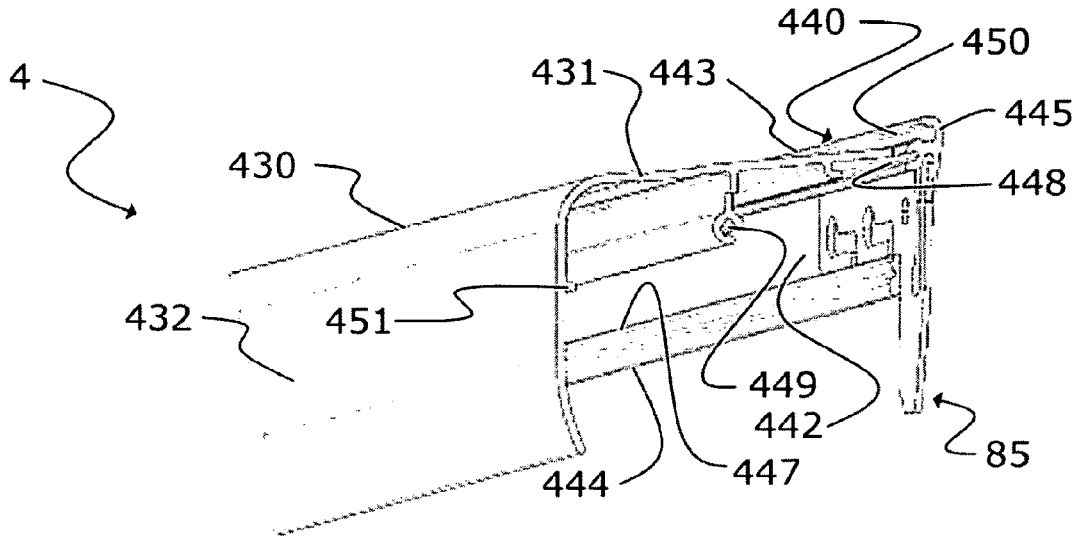
FIG. 4 shows, on a still larger scale, a perspective view of a part of the detail of the screening arrangement shown in FIG. 3.

Turning now to FIGS. 3 and 4 depicting the top element 4 in one embodiment of the screening arrangement, it may be seen that the top element 4 has a left-hand end piece 410 and a right-hand end piece (not shown). The terms "left-hand" and "right-hand" refer to the orientation shown in for instance FIGS. 1 to 3 and are utilized for reasons of convenience only. Similarly, the terms "front" and "back" are utilized to denote the sides of the screening arrangement, "front" being the side intended to face inwards into the room of the building, and "back" the outwards facing side.

The top element 4 comprises a cover 430 extending almost throughout the entire length of the top element 4 from the left-hand end piece 410 to the right-hand end piece, the end pieces thus constituting the end faces of the top element 4. At the side intended to face inwards into the room, i.e. the front side, the cover 430 is connected to a top rail 440. In the embodiment shown, the connection between the top rail 440 and the remaining portion of the top element, i.e. the cover 430 is made integral, e.g. by extruding the top element as a profile including the cover 430 as well as the top rail 440. The end piece 410 is adapted to be fastened to the cover 430 by means of e.g. a screw (not shown) to be received in threaded track 449 in the cover 430.

The top rail 440 has a front side 441, a back side 442, a top edge 443 and a bottom edge 444, and extends in a first longitudinal direction between a first mitred end 445 and a second mitred end (not visible in FIGS. 3 and 4). The top rail 440 has a predetermined height between the bottom edge 444 and the top edge 443. The height may e.g. lie in the interval 2 to 5 cm, but is preferably as small as possible. In the mounted position shown in FIG. 1, the first longitudinal direction corresponds to the width direction of the frame to be screened. In the embodiment shown, the front side 441 has a slightly curved configuration, but other configurations, such as plane or inclined front sides are conceivable as well. In the back side 442 of the top rail 440 a track 447 is provided, the function of which will be described in further detail below. In the embodiment shown, the top rail 440 has a larger extent than the cover 430 of the top element in the first longitudinal direction, thus leaving room for a coupling member at each end of the top element. In the embodiment shown, such a coupling member is formed integrally on the end piece 410. Eventually, the top rail 440 has a protruding flange 450 extending between the first mitred end and the second mitred end and having a predefined height.

The cover 430 has a top cover portion 431 and a back cover portion 432, a rib 451 being formed in the back cover portion 432. It is conceivable to have a bottom cover portion as well. Of course, such a bottom cover portion could only cover a part of the distance from the back side towards the screening plane in order not to come into conflict with the screening body 6.

The configuration of the components inside the top element 4 is particular to the kind of screening arrangement in question and will not be described in further detail. One example of such a configuration is, e.g., described in Applicant's co-pending application filed on the same day as the present application.

On the outer side, the end piece 410 comprises portions constituting coupling members for cooperation with bracket members positioned on the side piece 23 of the window sash 2. The opposite, right-hand end piece has an outer side configured in a substantially mirror-inverted manner. The bracket members may, in principle, have any suitable form as long as they permit swift and secure connection with the screening arrangement. One example of such bracket members is shown in Applicant's published international applications Nos WO 2005/008013 and WO 2006/048014, the contents of which are incorporated herein by reference. Such a coupling member is traditionally formed as a separate part connected with the remaining parts of the screening arrangement, one example being described in detail in Applicant's published international application No. WO 00/47858. Although the coupling members of the present invention are made integral with the respective end pieces the following features provided in the coupling members disclosed in this document are present: The end piece 410 comprises guide surfaces 411, 412 for correct positioning, and resilient engagement means in the form of a tongue 413 allowing temporary positioning on the bracket member, including snap engagement means in the form of upstanding retaining pawl 414. Furthermore, the end piece has spring means (not shown) for cooperation with the corresponding side rail.

Eventually, the screening arrangement comprises a parallel guidance cord system comprising two cords (not shown), one cord being adapted to extend from the left-hand lower corner of the sash, up through or along the bottom element 7 and further up to the top element 4. The other cord is routed in a mirror-inverted manner. At the top element 4, each cord is connected with a respective pre-tensioning device adapted to be connected with the top element 4 in the track 448 formed in the cover 430. The pre-tensioning devices entail that the cords are held at a suitable tension all of the time, thereby ensuring that the bottom element 7 is at all times kept substantially in parallel with the top and bottom pieces 21, 22 of the sash 2 during operation of the screening arrangement.

As mentioned in the above, the screening arrangement 1 comprises side rails 8, 9, which, i.a., serve the purpose of improving the light-proofing properties of the screening arrangement, as they overlap the side edges of the screening body in the mounted position of the screening arrangement. In the screening according to the invention, the side rails form part of the mitre joint with the top rail 440 of the top element 4. Furthermore, the cords are hidden behind the side rails. Eventually, depending on the type of screening body and the installation situation, the side rails may contribute to holding the screening body in position.

Figure 5:
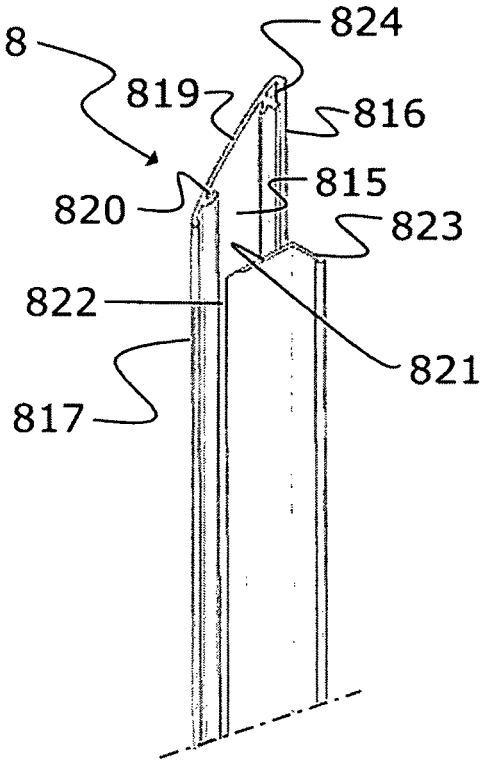
FIG. 5 shows, on a larger scale, a partial perspective view of a detail of the screening arrangement in an embodiment of the invention.

Referring now in particular to FIG. 5, the left-hand side rail 8 will be described: The side rail 8 has a front side 814, a back side 815, a longer edge 816 and a shorter edge 817, and extends in a second longitudinal direction between a first end (not shown in FIG. 5) and a second mitred end 819. In the back side 815 a track 820 acting as a reception means for an angular bracket is provided. A further track 821 having a longitudinally extending aperture 822 is adapted for receiving the side edge of the screening body and one end of the bottom element. A flange 823 extending at substantially right angle to the plane defined by the two longitudinal directions, i.e. by the track 820, abuts, in the mounted position, the inner side face of the frame side piece 23, i.e. the face closest to the panel element of the window. The small flange portion 824 overlaps part of the front face of the frame side piece 23 to provide for an overlap between the side rails and the frame side pieces. For use in frames having a bevelled inner side face, i.e., in which the inner side face forms an angle slightly larger than 90° with the front face, the side rails of the screening arrangement may be formed with a corresponding angle between the flange 823 and the plane defined by the track 820. Eventually, the side rail 8 is provided with an aperture 825 located in flange 823. The aperture 825 is situated at a distance from the second mitred end 819. There may be more than one aperture along the side rail 8.

Just as the top rail 440 has a predetermined height, each side rail 8, 9 has a predetermined width, and in the embodiment shown the predetermined height is substantially the same as said predetermined width, the mitre joint thus being a 45° mitre joint. Other angles are conceivable, however, this entails that a similar configuration of the front sides of the three elements, i.e. top rail and two side rails, is not achievable.

The side rails 8, 9 are joined to the top element 40 by means of angular brackets 85 to form a mitre joint between the top rail 430 of the top element 4 and the respective side rail 8 and 9. The steps to be performed during the joining operation will be described in further detail during the below description of a preferred method of installing the screening arrangement.

Figure 6:
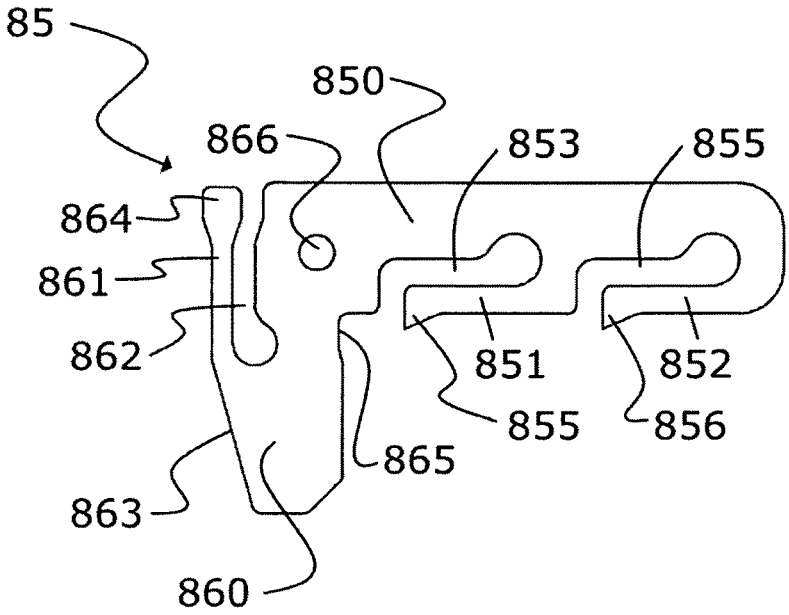
FIG. 6 shows, on a larger scale, a plane view of a detail of the screening arrangement in an embodiment of the invention.

Turning now to FIG. 6 and returning to FIG. 4, each angular bracket 85 has a substantially plane configuration forming an L and including a first leg 850 and a second leg 860. In the mounted position the first and second legs 850, 860 are positioned substantially in parallel with the plane defined by the first and second longitudinal directions. Furthermore, each angular bracket 85 is provided with a resilient adjustment portion. The resilient adjustment portion of each angular bracket 85 comprises at least one tongue 851, 852; 861 at one edge of each of the first and second leg 850, 860. The tongues 851, 852; 861 are separated from the remaining part of the angular bracket 85 by a respective slot 853, 855; 862, which provides for a springing or resilient effect. As is apparent from FIG. 6, the tongues 851, 852 of the first leg 850 are provided at a first edge, and the tongue 861 of the second leg 860 is provided on the second edge, i.e. on the inner and outer edge, respectively, of the L-shape. By forming the tongues 851, 852 at the first edge rather than at the opposite second edge, it is ascertained that the angular bracket 85 is positioned with the second edge of the first leg 850 in abutment with the top of the track 447. In turn, this improves the alignment of the ends facing each other in the mitre joint even further. By using two tongues instead of one it is secured that the first leg 850 is kept in parallel with the top rail 440. As shown in FIG. 4, the first leg 850 is adapted to be inserted into the track 447 in the back side 442 of the top rail 440, and the tongues 851, 852 of the first leg 850 each has a protrusion 855, 856 protruding from the edge of the first leg 850. In the supply condition (to be described further on), the protrusions 855, 856 act as arresting means preventing the angular bracket 85 to be extracted from the track 447. The second leg 860 is adapted to be inserted into the track 820 in the back side of the side rail 8, and one edge of the second leg 860 has an inclined portion 863. Each mitred end 445, 446 of the top rail 440 and the mitred end 819 of each side rail 8 is chamfered. Eventually, the angular bracket 85 is provided with an incision 865 to be described in further detail below and an aperture 866.

The screening arrangement furthermore includes a bottom element 7 and a screening body 6, said screening body including a first end edge, a second end edge and two side edges, the first end edge being accommodated in the top element 4 and the second end edge fastened to the bottom element 7, said bottom element being movable between a non-screening position close to the top element and a screening position at a distance from the top element, the side edges being guided in said side rails 8, 9.

The side edges of the screening body 6 are guided in the side rails 8, 9 in a manner known per se, for instance by means of a number of guide beads mounted at a distance from each other along each side edge.

The bottom edge of the screening body 6 is connected with the bottom element 7 in any suitable manner.

Mounting of the entire screening arrangement 1 in a frame, for instance the sash 2 of FIG. 1, is carried out in the following manner:

Initially, the screening arrangement is brought into a supply condition. This is preferably carried out at the manufacturer. First, a top element is provided with a top rail having a first mitred end and a second mitred end. Second, two side rails having a first end and second mitred end are provided. Third, a set of angular brackets is provided. Fourth, the angular brackets are connected to the top rail. This operation is advantageously carried out by a suitable tool to secure that the angular brackets assume correct positions. The screening arrangement is now in a condition corresponding to a supply condition.

At the installation site, the top element is connected to the frame. In the embodiment shown in the above, this is carried out by guiding the coupling members on the outer side of each end piece over bracket members positioned at the upper ends of each side piece. Finally, the side rails are joined to the top rail at the mitred ends by means of the angular brackets. During the final step of joining the side rails to the top rail each side rail is brought from a position, in which the side rail is out of alignment with the second longitudinal direction, to a position, in which the side rails is in alignment with the second longitudinal direction, during the step of connecting the side rails to the top rail. The steps performed during this operation are shown in further detail in FIGS. 7 to 10.

Figures 7, 8, 9, 10:
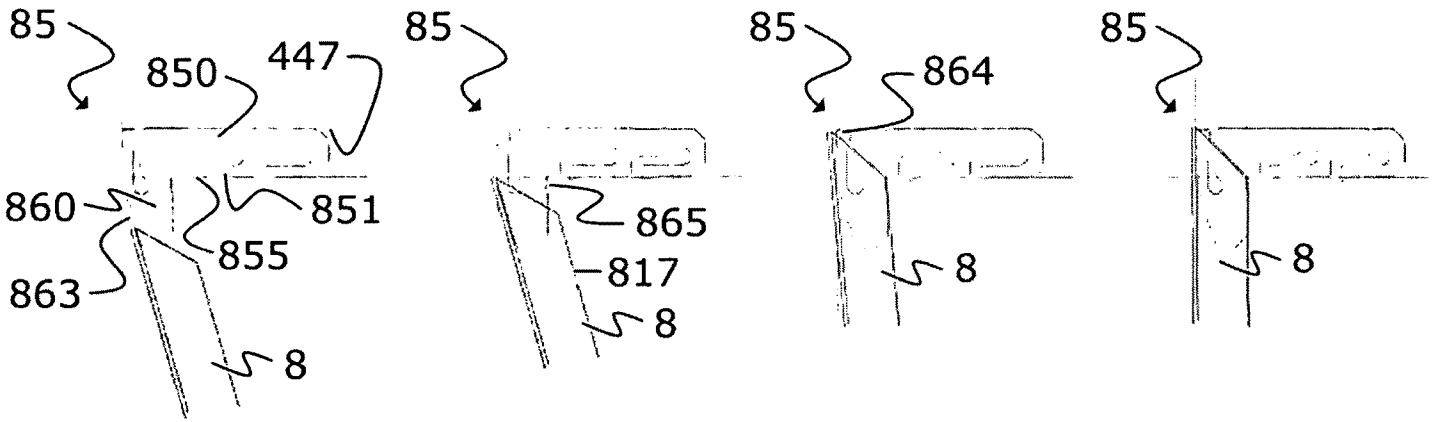
FIGS. 7 to 10 show views illustrating schematically the steps during mounting of a screening arrangement in an embodiment of the invention.

FIG. 7 shows, very schematically, the first leg 850 of the angular bracket 85 inserted into the track 447 of the top rail (the remaining portion of the top rail being omitted for clarity reasons). In this position, the first leg 850 is securely retained in track 447 by the protrusions on the tongues, here shown only protrusion 855 on tongue 851. The side rail 8 is guided onto the second leg 860 of the angular bracket 85, preferably as shown at an angle along the inclined portion 863 until the position shown in FIG. 8 has been obtained.

From the position shown in FIG. 8, the side rail 8 is guided either along the same inclined direction or more or less straight up towards the top rail past the incision 865 until the end of the shorter edge 817 reaches the connecting point between the two adjacent edges of the first and second legs 850, 860. In this position, the side rail 8 is pivoted about a point corresponding to the start of the incision 865, i.e. at a distance from the connecting points between the adjacent edges, and the side rail 8 is thus forced against the springing action of the head portion 864 and into a tight joint with the top rail. Subsequently, or simultaneously, the side rail 8 is connected to the side piece 23 of the sash by means of suitable fastening means. Such means may include screws introduced through aperture 825 and the other apertures along the side rail 8. As the uppermost aperture 825 of the side rail 8 is positioned at a distance from the second mitred end 819, a slight deformation of the side rail 8 may take place such that the mitre joint is not compromised. Furthermore, the fastening means may include fittings at the sash bottom piece 22. The other side rail 9 is connected to its respective side piece 24 in a similar manner. Slight deviations of the above described mounting procedure may, of course, occur.

The invention should not be regarded as being limited to the described embodiments. Several modifications and combinations of the different embodiments will be apparent to the person skilled in the art.

LIST OF REFERENCE NUMERALS

1 screening arrangement
2 sash
21 top piece
22 bottom piece
23 side piece
24 side piece
4 top element
410 left-hand end piece
411 guide surface
412 guide surface
413 tongue
414 retaining pawl
430 cover
431 top cover portion
432 back cover portion
440 top rail
441 front side
442 back side
443 top edge
444 bottom edge
445 first mitred end
446 second mitred end
447 track
448 track
449 track
450 flange
451 rib
6 screening body
7 bottom element
8 side rail
814 front side
815 back side
816 longer edge
817 shorter edge
818 first end
819 second mitred end
820 track
821 track
822 aperture
85 angular bracket
850 first leg
851 tongue
852 tongue
853 slot
854 slot
855 protrusion
856 protrusion
860 second leg
861 tongue
862 slot
863 inclined portion
864 head portion
865 incision
866 aperture
9 siderail

The invention claimed is:

1. A screening arrangement (1) adapted to be mounted in a frame (2) to obtain a mounted position, consisting of a top element (4) including a cover (430) extending, in the mounted position, in a first longitudinal direction defining a width direction, two side rails (8, 9), each side rail extending, in the mounted position, in a second longitudinal direction defining a height direction, a set of angular brackets (85), a screening body (6) including a first end edge, a second end edge and side edges, and a bottom element (7), the first end edge being accommodated in the top element (4)) and the second end edge being fastened to the bottom element (7), said bottom element being movable between a non-screening position close to the top element and a screening position at a distance from the top element, and a center between the two side rails and below the top element, said first and second longitudinal directions defining a plane, characterized in that said top element (4) is provided with a top rail (440) forming the front side of the top element and being connected to the cover (430) of the top element (4), said top rail (440) extending in said first longitudinal direction between a first mitred end and a second mitred end, each of said side rails (8, 9) having a first end and a second, mitred end, the second, mitred end of each side rail (8, 9) being adapted to be joined to the first mitred end and the second mitred end, respectively, of said top rail (440), wherein each angular bracket (85) has a first leg (850) and a second leg (860), said first and second legs (850,860) being positioned substantially in parallel with said plane in the mounted position, and wherein each angular bracket cooperates with reception means in the back side of the top rail (440), between the cover and the center of the screening arrangement, and in the back side of the respective side rail (8, 9), wherein said reception means comprises a track in the back side of the top rail (440) and a track in the back side of each side rail (8,9).

2. A screening arrangement according to claim 1, wherein the top rail (440) has a predetermined height and each side rail (8, 9) has a predetermined width, and wherein said predetermined height is substantially the same as said predetermined width, the mitre joint thus being a 45° mitre joint.

3. A screening arrangement according to claim 1, wherein each angular bracket (85) is provided with a resilient adjustment portion.

4. A screening arrangement according to claim 3, wherein the resilient adjustment portion of each angular bracket (85) comprises at least one tongue (851, 852; 861) at one edge of at least one leg (850, 860).

5. A screening arrangement according to claim 4, wherein at least one tongue (851, 852; 861) is provided on one of the edges of each leg (850, 860).

6. A screening arrangement according to claim 5, wherein the at least one tongue (851, 852) of the first leg (850) is provided at a first edge, and the at least one tongue (861) of the second leg (860) is provided on the second edge.

7. A screening arrangement according to claim 4, wherein the first leg (850) is adapted to be inserted into the track (447) in the back side of the top rail (440), the at least one tongue (851, 852) of the first leg (850) having a protrusion (855, 856) protruding from the edge of the first leg (850).

8. A screening arrangement according to claim 1, wherein the second leg (860) is adapted to be inserted into the track (820) in the back side of the side rail (8, 9), one edge of the second leg (860) having an inclined portion (863).

9. A screening arrangement according to claim 1, wherein the angular bracket (85) is provided with an incision (865).

10. A screening arrangement according to claim 1, wherein said top rail (440) is provided with a protruding flange extending between the first mitred end and the second mitred end and having a predefined height, and wherein each side rail (8, 9) is provided with a protruding flange extending between the first end and the second mitred end and having a predefined width.

11. A screening arrangement according to claim 1, wherein each mitred end of the top rail (440) and of each side rail (8, 9) is chamfered.

12. A screening arrangement according to claim 1, wherein the top rail (440) has a larger extent than the cover (430) of the top element in the first longitudinal direction, thus leaving room for a coupling member at each end of the top element.

13. A screening arrangement according to claim 1, wherein each bracket has a nonsymmetrical, planar configuration that is not sinuously shaped in a direction transverse to a plane defined by the angular bracket.

14. A screening arrangement according to claim 1, wherein the side edges are guided in said side rails.

* * * * *